US010973617B2

(12) United States Patent
Eilts

(10) Patent No.: US 10,973,617 B2
(45) Date of Patent: Apr. 13, 2021

(54) ARTIFICIAL VAGINA SET

(71) Applicant: Bruce Eilts, Baton Rouge, LA (US)

(72) Inventor: Bruce Eilts, Baton Rouge, LA (US)

( * ) Notice: Subject to any disclaimer, the term of this patent is extended or adjusted under 35 U.S.C. 154(b) by 593 days.

(21) Appl. No.: 15/936,822

(22) Filed: Mar. 27, 2018

(65) Prior Publication Data

US 2019/0298505 A1 Oct. 3, 2019

(51) Int. Cl.
*A61D 19/02* (2006.01)

(52) U.S. Cl.
CPC ..... *A61D 19/021* (2013.01)

(58) Field of Classification Search
CPC ..... A61D 19/02
See application file for complete search history.

(56) References Cited

U.S. PATENT DOCUMENTS 2,686,519 A * 8/1954 Westerman ..... A61D 19/021 604/347
2,808,834 A * 10/1957 Marden ..... A61D 19/021 607/39
3,547,102 A * 12/1970 Frenkel ..... A61H 23/0254 600/575
4,312,350 A * 1/1982 Doan ..... A61B 10/0058 604/349
4,620,531 A * 11/1986 Dyer ..... A61B 10/0058 604/349
4,744,352 A * 5/1988 Emery ..... A61D 19/021 604/349
4,984,582 A * 1/1991 Romaniszyn ..... A61F 6/00 128/844
D330,762 S * 11/1992 Anderson ..... A61D 19/021 D24/108
5,437,652 A * 8/1995 Anatolievich ..... A61D 19/021 604/349
5,540,670 A * 7/1996 Lindholm-Ventola ..... A61B 10/0058 600/575
5,685,871 A * 11/1997 Lindholm-Ventola ..... A61D 19/021 604/349
5,695,446 A * 12/1997 Lindholm-Ventola ..... A61B 10/0058 600/38

(Continued)

FOREIGN PATENT DOCUMENTS

CN 201370650 Y 12/2009

OTHER PUBLICATIONS

Eilts, Bruce, Stallion Breeding Soundness Examination, Sep. 14, 2010, http://www.vetmed.lsu.edu/eiltslotus/theriogenology-5361/stallion.htm, Baton Rouge, LA.

(Continued)

*Primary Examiner* — Guy K Townsend
(74) *Attorney, Agent, or Firm* — John B. Edel; Edel Patent LLC

(57) ABSTRACT

Artificial vaginas are disclosed that include an elongate housing, a liner within the elongate housing that is attached to the elongate housing, and a pressurized air tank arranged to bring the artificial vagina to an appropriate pressure. Such artificial vaginas may be brought to an operation temperature for the collection of semen by an air infuser that may contain a blower, a heating element and a shaft having a plurality of apertures through which heated air may flow.

16 Claims, 2 Drawing Sheets

(56) References Cited

U.S. PATENT DOCUMENTS

| | | | | |
|---|---|---|---|---|
| 6,090,088 | A * | 7/2000 | Nichols | A61D 19/021 119/838 |
| 6,554,811 | B2 * | 4/2003 | Barth | A61D 19/021 128/830 |
| 7,041,064 | B2 * | 5/2006 | Vayer | A61D 19/021 600/562 |
| 7,217,239 | B1 * | 5/2007 | Dyer | A61D 19/021 600/33 |
| 10,195,009 | B2 * | 2/2019 | Schmitt | A61D 19/021 604/349 |
| 2002/0032419 | A1 * | 3/2002 | Barth | A61D 19/021 604/349 |
| 2007/0282285 | A1 * | 12/2007 | Yvoz | A61D 19/021 604/349 |
| 2009/0137974 | A1 * | 5/2009 | Yvoz | A61D 19/021 604/349 |
| 2010/0069706 | A1 * | 3/2010 | Rousere | A61D 19/021 600/33 |
| 2015/0265386 | A1 * | 9/2015 | Schmitt | A61D 19/021 604/349 |
| 2017/0239030 | A1 * | 8/2017 | Eilts | A61D 19/021 604/349 |
| 2019/0298505 | A1 * | 10/2019 | Eilts | A61D 19/021 604/349 |
| 2019/0358011 | A1 * | 11/2019 | Schmitt | A61D 19/021 604/349 |
| 2019/0358012 | A1 * | 11/2019 | Schmitt | A61D 19/022 604/349 |

OTHER PUBLICATIONS

Experimental use description, Mar. 26, 2018.

* cited by examiner

ARTIFICIAL VAGINA SET

Artificial vaginas described herein may be used as part of artificial insemination of animals. Artificial vaginas described herein may be particularly useful in equine artificial insemination and more particularly in the collection of semen from a stallion. Certain artificial vaginas disclosed herein may be lightweight, may provide temperature control and may provide pressure control.

DETAILED DESCRIPTION

Example 1

Figure 1:
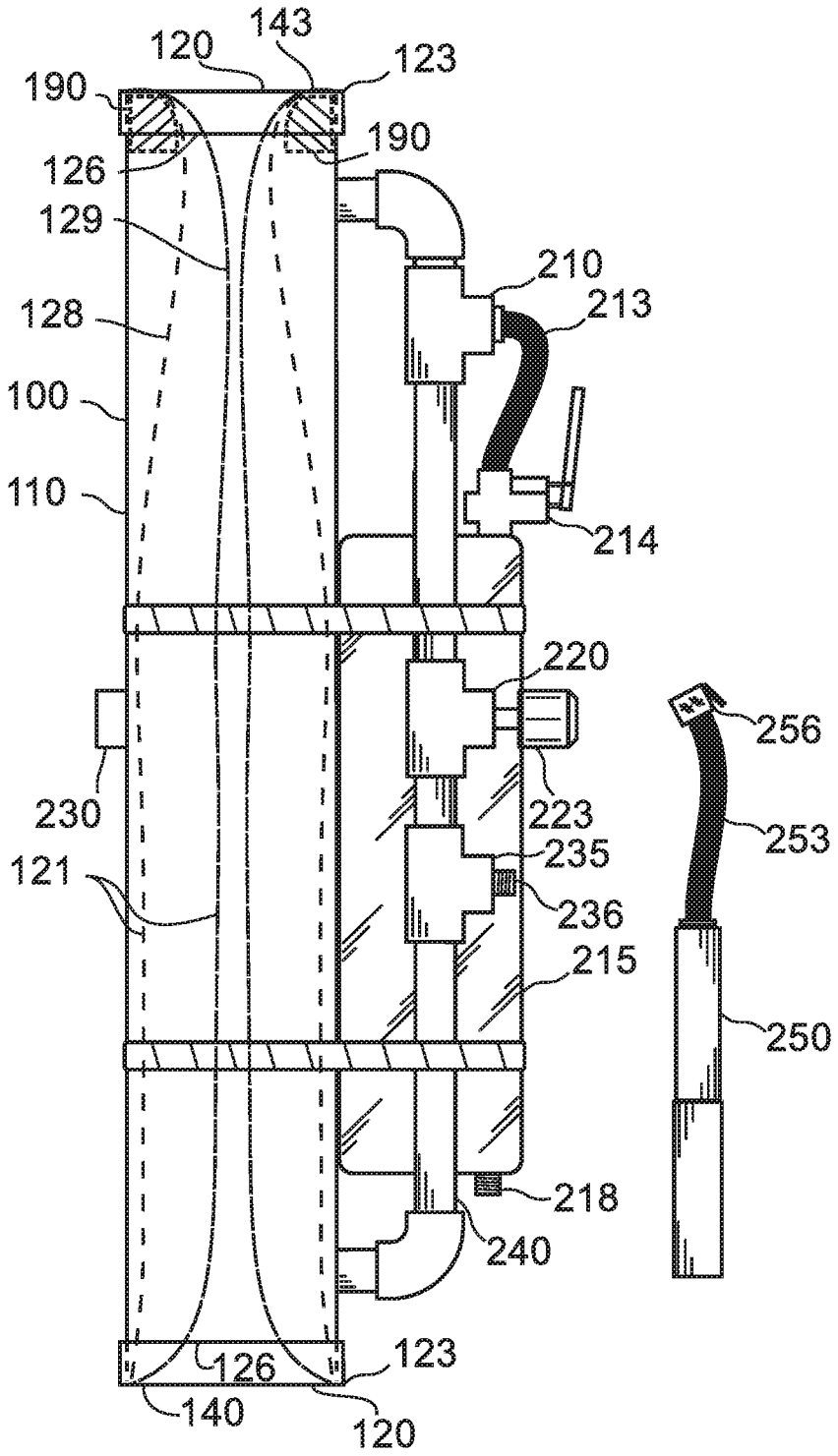
FIG. 1 shows an elevation view of the artificial vagina.

FIG. 1 depicts an elevation view of the artificial vagina. Shown in FIG. 1 are: Artificial vagina 100, Housing 110, Liner 120, Flexible annular bladder 121, Liner folds 123, Liner Ends 126, Dilated position 128, Contracted position 129, Entry end 140, Collection end 143, Artificial cervix 190, First Port 210, Pneumatic hose 213, Fill valve 214, Pressure tank 215, Valve stem 218, Second Port 220, Relief valve 223, Third port 230, Fourth port 235, Valve stem 236, Handle 240, Air pump 250, Air hose 253 and Valve clamp 256. Artificial vagina 100 includes a Housing 110 and a Liner 120. Housing 110 may for example be a cylinder having a 4.5 inch internal diameter and 20 inch length. The housing length may be between 18 and 24 inches and in certain other examples may be between 14 and 36 inches. The housing internal diameter may be between 4 and 5 inches and in certain examples may be between 3.5 and 7.5 inches. Flexible annular bladder 121 is the roughly annular shaped inflatable bag formation within Housing 110 which is formed by the joining of Housing 110 and Liner 120. Liner 120 is situated predominately within Housing 110. Liner 120 is the flexible and inflatable portion of Flexible annular bladder 121. Liner 120 may, for example be a 70 cm long rubber Hannover artificial vagina inner liner with rolled ends as sold under model number 11222/0003 by Minitube USA, Inc. P.O. Box 306 Delavan, Wis. 53115. Liner folds 123 on each end of Housing 110 allow the Liner Ends 126 to be sealed against the exterior of Housing 110 thereby creating Flexible annular bladder 121. Flexible annular bladder 121 may be in a Dilated position 128 or a Contracted position 129 depending on the various forces applied to Liner 120. For example, when pressure is applied to the annular space between Liner 120 and Housing 110 Flexible annular bladder 121 may inflate to Contracted position 129. Artificial vagina 100 may be configured to have an Entry end 140 and a Collection end 143 which may be interchangeable depending on the particular configuration of Artificial vagina 100. Entry end 140 and Collection end 143 may be designated by the use of Artificial vagina 100 such that Entry end 140 is the end that is penetrated by the male reproductive member and Collection end 143 is the end in which semen is collected. Artificial cervix 190 may be located at Collection end 143 and may allow for the flaring of a stallion's penis in a manner similar to the contacting of the penis with an actual cervix. Artificial cervix 190 may be a doughnut shaped piece within Collection end 143 and may be constructed of foam rubber other foams or other materials having the ability to flare the penis. Artificial cervix 190 may be located between Liner 120 and Housing 110. Pressure tank 215 may be used to selectively pressurize the interior of Flexible annular bladder 121. Pressure tank 215 may, for example, be in fluid communication with the interior of Flexible annular bladder 121 by way of Fill valve 214, Pneumatic hose 213, First Port 210 and Handle 240 such that the temporary opening of Fill valve 214 causes pressurized air within Pressure tank 215 to pass into Flexible annular bladder 121. In the depicted embodiment, Handle 240 is configured as piping or tubing that allows airflow through the handle and is structurally sufficient to reliably serve as a handle for Artificial vagina 100. The operation of Fill valve 214 may pressurize Flexible annular bladder 121 to the operating pressure for Artificial vagina 100. Pressure tank 215 may be pressurized by connecting Air pump 250 to Valve stem 218 such that Air pump 250 forces pressurized air through Valve stem 218 into Pressure tank 215. Air pump 250 may take various forms including a manual or automatic pump, a compressor, a blower or other device suitable for creating the appropriate pressure in Pressure tank 215 sufficient to adequately adjust Flexible annular bladder 121 to an appropriate operating pressure. As depicted in FIG. 1, Air pump 250 is equipped with an Air hose 253 and a Valve clamp 256 for convenient attachment to the valve stems positioned on Artificial vagina 100. Pressure tank 215 may be sized, configured and pressurized to inflate Flexible annular bladder 121 to operating pressure more than one time. Second Port 220 may be in fluid communication with both Relief valve 223 and Flexible annular bladder 121. Relief valve 223 may be an adjustable pressure relief valve. Relief valve 223 may be configured to have a range of operating pressures sufficient to encompass the range of desirable pressures for collecting semen and may be configured such that it is capable of relieving the pressure in Flexible annular bladder 121 down to ambient pressure. Relief valve 223 may, for example, be set to 30 mmHg. The air introduced through First Port 210 may be preheated air or maybe air of ambient temperature. When collecting from an animal, Flexible annular bladder 121 may be inflated such that it substantially fills the space within Housing 110 or such that it fills a substantial portion of the space within Housing 110. Insertion of the male reproductive member into Housing 110 generally along the central axis of Housing 110 may cause a portion of the air in Flexible annular bladder 121 to be expelled through Relief valve 223 thereby producing a desirable pressure and fit for the male reproductive member facilitating the collection of semen. Third port 230 may be omitted, may be used for a pressure gauge to indicate the internal pressure of Flexible annular bladder 121 or may be used as an exhaust port allowing the escape of air from Flexible annular bladder 121. A variety of port locations may be used either on Handle 240 or positioned in other locations on Artificial vagina 100 and the location of those ports may be selected based on factors such as convenience, ease and evenness of heating among other factors.

Figure 2:
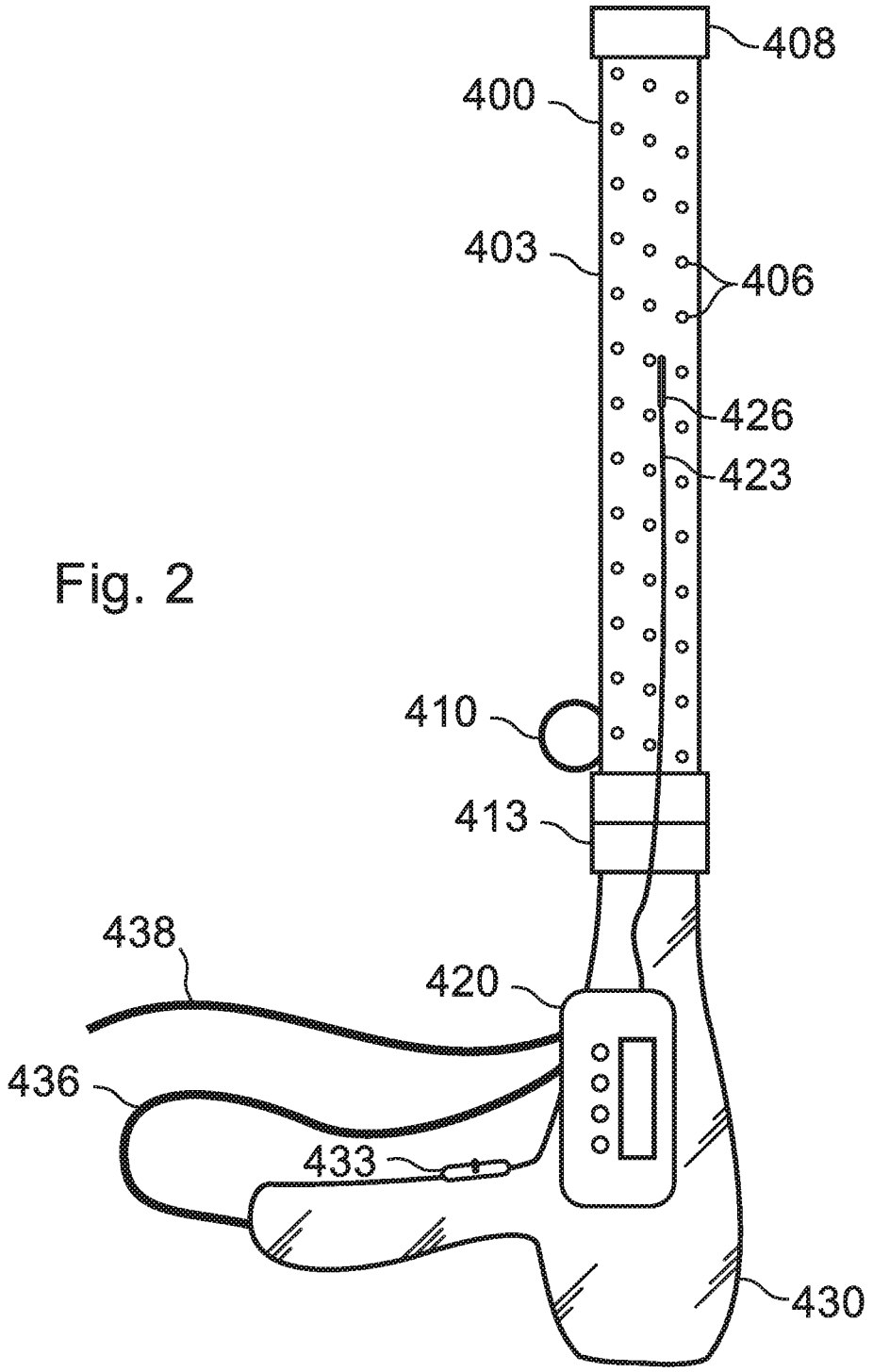
FIG. 2 shows an elevation view of the hot air infuser.

FIG. 2 shows a Hot air infuser 400 which includes Infuser tube 403, Infusion holes 406, Infusion cap 408, Centering ring 410, Infuser heater coupling 413, Temperature controller 420, Temperature sensor wire 423, Temperature sensor 426, Heater blower unit 430, Heater blower switch 433, Heater blower power cord 436 and Temperature controller power cord 438. Hot air infuser 400 is arranged in configured to fit within Housing 110 of Artificial vagina 100 and may be used to bring Liner 120 up to operating temperature for the use of Artificial vagina 100 in collecting semen. The portions of Hot air infuser 400 that may be inserted into Housing 110 of Artificial vagina 100 may include Infuser tube 403, Infusion cap 408, Temperature sensor wire 423 and Temperature sensor 426. Infuser tube 403 is the portion of Hot air infuser 400 which conveys hot air into Housing 110. Infuser tube 403 contains Infusion holes 406 through which the hot air is delivered. When Infuser tube 403 is inside of Housing 110, Temperature sensor 426 may be located in between Infuser tube 403 and Liner 120. In such situations, Liner 120 or a lubricated commercially available disposable plastic artificial vagina collection liner may be in contact with Temperature sensor 426. The disposable plastic artificial vagina collection liner would typically be inside Housing 110 of Artificial vagina 100 during the collection of semen. The disposable plastic artificial vagina collection liner may for example be the 22" disposable collection liner sold under part number SAVL-101/25 by Animal Reproduction Systems, Inc. In such cases the disposable plastic artificial vagina collection liner would be attached at Entry end 140. Direct contact with either liner is not necessary for the temperature control operation of Hot air infuser 400. For example, an envelope of heated air may separate the liners from Infuser tube 403. Centering ring 410 may act to facilitate the proper positioning of Infuser tube 403 within Artificial vagina 100 by acting as a spacer between the surface on which Artificial vagina 100 rest and Infuser tube 403. In the embodiment depicted in FIG. 2, Heater blower unit 430 is depicted as taking the form of a hair dryer. However, other heater blower combinations may be used including heater blower combinations that are more compact and modular. For example, Temperature controller 420 may be integrated into a single heater blower unit such that only a single external wire is needed to power the device. As shown in FIG. 2, Temperature controller 420 may be connected to Temperature sensor 426 by way of Temperature sensor wire 423 such that Temperature controller 420 operates Heater blower unit 430 according to temperature readings provided from Temperature sensor 426 relative to a temperature set point. The temperature set point may be dictated by operator experience and the particular preference of the stallion from which semen is being collected. Temperature controller power cord 438 may provide power to Temperature controller 420 which in turn may power Heater blower unit 430 by way of Heater blower power cord 436. Temperature controller 420 may provide a power on/power off control scheme to Heater blower unit 430 or may provide more nuanced power control allowing for variable blower speed and or variable heat input. Heater blower switch 433 may provide a simple on off control of Heater blower unit 430 or may provide a variety of power settings such as may be available in commercially available hairdryers. Infuser heater coupling 413 is configured to attach Infuser tube 403 to Heater blower unit 430. Infuser heater coupling 413 may be configured to provide an enduring attachment or may be configured for removable attachment such as by a friction fit over the output nozzle of Heater blower unit 430. Infuser tube 403, Infusion cap 408, Centering ring 410 and Infuser heater coupling 413 may be constructed of polyvinylchloride piping components. Hot air infuser 400 may for example be configured to run off of a 120V AC power source, other AC power sources, a 12V DC power, source, or other DC power sources including batteries. Liner 120 and Housing 110 may be sized and configured for the collection of semen from a stallion.

Example 2

The present example describes the collection of semen from a stallion using the embodiment depicted in FIGS. 1 and 2. Artificial vagina 100 may be prepared for use in advance by pressurizing Pressure tank 215 with Air pump 250 through Valve stem 218. During such pressurization, Fill valve 214 would be in its normally closed position. This pressurization step may occur before, during or after the heating step. A lubricated commercially available disposable plastic artificial vagina collection liner, such as may be used with water filled artificial vaginas, may be used with Artificial vagina 100 and positioned within. Liner 120. Prior to initiating heating of Liner 120, Flexible annular bladder 121 may be deflated, brought to ambient pressure or brought to near ambient pressure such that Liner 120 is either in Dilated position 128 or may be made to conform to Dilated position 128 with very little pressure on Flexible annular bladder 121. The reduction in pressure may, for example, be accomplished by operating Valve stem 236 to release air from the valve. Hot air infuser 400 may then be inserted into Artificial vagina 100 such that Infuser tube 403 is substantially encompassed by Liner 120 and substantially encompassed by and adjacent to the lubricated commercially available collection liner within Artificial vagina 100. The insertion of Hot air infuser 400 into Artificial vagina 100 may be regarded as complete when Centering ring 410 is adjacent to Liner 120 at Entry end 140. Temperature controller 420 may then be set at a temperature appropriate for the animal from which a sample is being collected followed by switching on Heater blower unit 430 at Heater blower switch 433. Warm or hot air then passes through Infusion holes 406 thereby heating the annular space between Infuser tube 403 and Flexible annular bladder 121. The control scheme implemented by Temperature controller 420 is such that the air in the annular space between Infuser tube 403 and Flexible annular bladder 121 is maintained at or slightly above the desired temperature for the collection of semen. Because Liner 120 is in the Dilated position 128 during the warming of Liner 120 any folds that might have been present in the Contracted position 129 are minimized thereby enhancing evenness of the temperature distribution in Liner 120. Artificial vagina 100 may be kept in a ready state with Hot air infuser 400 positioned in and warming Artificial vagina 100 until a stallion is ready for collection. The state of readiness of Artificial vagina 100 may be maintained, for example, by Temperature controller 420 turning on Heater blower unit 430 each time Temperature sensor 426 detects a temperature below the temperature setpoint. A preliminary fit may be established by one or more of adding air to Flexible annular bladder 121 through the operation of Fill valve 214, adjusting Relief valve 223 to relieve any pressure above the desired pressure and manually forcing air from Flexible annular bladder 121 by way of inserting a hand into Artificial vagina 100. With Artificial vagina 100 at the correct temperature and pressure, when the stallion is ready for collection, the penis of the stallion may be guided into Entry end 140 of Artificial vagina 100. The penis of the stallion may force additional air from Relief valve 223 upon entry into Artificial vagina 100 or at any time up to and including collection. The amount of air released may be proportional to and appropriate for the size of the penis from which the semen is being collected. The release of such air may be beneficial and allow for a more consistent pressure than is typical of water based artificial vaginas.

The operating temperature of Flexible annular bladder 121 may, for example, be 48° C. The body of Artificial vagina 100 may remain positioned on Hot air infuser 400 until it is ready for use. Use of Artificial vagina 100 may proceed in a manner comparable to the use of prior art water filled artificial vaginas however the version of Artificial vagina 100 depicted in FIG. 1 and various alternate embodiments may be capable of expelling air through Relief valve 223 thereby producing a desirable pressure and fit for the male reproductive member as described above. Commercially available collection liners may be used with Artificial vagina 100 and positioned within Liner 120.

A large number of potential examples are consistent with the disclosures of the preceding examples. A significant portion of those potential examples may be characterized by the features of the example sets described below. Table 1 below describes 16 such groups of embodiments. For example, Example Set 1A describes a group of embodiments in which the relief valve pressure is at least 5 mmHg, the relief valve pressure is at most 45 mmHg, the liner operating temperature is at least 40° C. and the housing length is at least 18 in.

TABLE 1

| Example Set | Relief valve pressure is at least (mmHg) | Relief valve pressure is at most (mmHg) | Liner operating temperature is at least (° C.) | Housing length is at least (in) |
|---|---|---|---|---|
| 1 A | 5 | 45 | 40 | 18 |
| 1 B | 15 | 45 | 40 | 18 |
| 1 C | 5 | 60 | 40 | 18 |
| 1 D | 15 | 60 | 40 | 18 |
| 1 E | 5 | 45 | 35 | 18 |
| 1 F | 15 | 45 | 35 | 18 |
| 1 G | 5 | 60 | 35 | 18 |
| 1 H | 15 | 60 | 35 | 18 |
| 1 I | 5 | 45 | 40 | 14 |
| 1 J | 15 | 45 | 40 | 14 |
| 1 K | 5 | 60 | 40 | 14 |
| 1 L | 15 | 60 | 40 | 14 |
| 1 M | 5 | 45 | 35 | 14 |
| 1 N | 15 | 45 | 35 | 14 |
| 1 O | 5 | 60 | 35 | 14 |
| 1 P | 15 | 60 | 35 | 14 |

A large number of potential examples are consistent with the disclosures of the preceding examples and a significant portion of those potential examples may be characterized by the features of the example sets described below.

As used herein the "initial fill percent" is the percentage of the internal volume of Housing 110 occupied by Flexible annular bladder 121 after removal from Hot air infuser 400 and after inflation of Flexible annular bladder 121 but before the insertion of the male reproductive organ. The initial fill percentage may, for example, be 80%. As used herein the "operational air expulsion percent" is the mass percentage of air expelled from Flexible annular bladder 121 during the semen collection. The operational air expulsion percent may, for example, be 20% or 30%. The parameters set out in Table 2 may be used to characterize certain groups of embodiments of which certain versions of the embodiments depicted in FIGS. 1 and 2 are members and of which many other alternate embodiments are members. Table 2 below describes 16 such groups of embodiments. For example, Example Set 2A describes a group of embodiments in which the operating pressure is at least 10 mmHg, the housing internal diameter is at least 3.5 inches, the initial fill percent is at least 50% and the operational air expulsion percent is at least 5%. Each of Example Sets 2A-2P of Table 2 may share characteristics with any of Example Sets 1A-1P of Table 1 and each such combination may be descriptive of a subset of embodiments which may be practiced in combination with the other features and characteristics described herein. By way of example, the subset of Example Set 2A having the features of Example Set 1A describes a group of embodiments in which the relief valve pressure is at least 5 mmHg, the relief valve pressure is at most 45 mmHg, the liner operating temperature is at least 40° C., the housing length is at least 18 inches, the operating pressure is at least 10 mmHg, the housing internal diameter is at least 3.5 inches, the initial fill percent is at least 50% and the operational air expulsion percent is at least 5%.

TABLE 2

| Example Set | Operating pressure is at least (mmHg) | Housing internal diameter is at least (in) | Initial fill percent is at least (%) | Operational air expulsion percent is at least (%) |
|---|---|---|---|---|
| 2 A | 10 | 3.5 | 50 | 5 |
| 2 B | 20 | 3.5 | 50 | 5 |
| 2 C | 10 | 4.0 | 50 | 5 |
| 2 D | 20 | 4.0 | 50 | 5 |
| 2 E | 10 | 3.5 | 70 | 5 |
| 2 F | 20 | 3.5 | 70 | 5 |
| 2 G | 10 | 4.0 | 70 | 5 |
| 2 H | 20 | 4.0 | 70 | 5 |
| 2 I | 10 | 3.5 | 50 | 10 |
| 2 J | 20 | 3.5 | 50 | 10 |
| 2 K | 10 | 4.0 | 50 | 10 |
| 2 L | 20 | 4.0 | 50 | 10 |
| 2 M | 10 | 3.5 | 70 | 10 |
| 2 N | 20 | 3.5 | 70 | 10 |
| 2 O | 10 | 4.0 | 70 | 10 |
| 2 P | 20 | 4.0 | 70 | 10 |

Artificial vagina sets described herein may, for example, comprise an elongate housing having a first opening and a second opening; a liner located within the elongate housing such that the liner is attached to the elongate housing; a volume of air between the elongate housing and the liner; an opening centrally located within the elongate housing and the liner; such that the volume of air surrounds the opening; such that the volume of air is both annular and cylindrical; a first valve in fluid communication with the volume of air; a pressurized air tank in fluid communication with the first valve; a second valve in fluid communication with the volume of air, such that the second valve is a pressure relief valve; a heating element; a blower; a shaft having a plurality of apertures arranged along a length of the shaft; such that the plurality of apertures is in fluid communication with the heating element; such that the plurality of apertures is in fluid communication with the blower and such that the shaft is sized to fit within the opening. In a related example, the artificial vagina set may have a pump. In a related example, the elongate housing may be at least 14 inches long. In a related example, the elongate housing may have an internal diameter of at least 3.5 inches. In a related example, the artificial vagina set may have temperature sensor attached to the shaft. In a related example, the artificial vagina set may have a temperature controller configured to operate the heating element. In a related example the second valve may be a variable pressure relief valve.

Methods of collection described herein may, for example, comprise placing a shaft of an air infuser inside of an artificial vagina; wherein the artificial vagina comprises: an elongate housing, a liner located within the elongate housing such that the liner is attached to the elongate housing, a first volume of air between the elongate housing and the liner, an opening centrally located within the elongate housing and the liner, a first valve in fluid communication with the first volume of air, a pressurized air tank in fluid communication with the first valve and a second valve in fluid communication with the first volume of air such that the second valve is a pressure relief valve; such that the air infuser comprises a heating element and a blower; such that the shaft has a plurality of apertures arranged along a length of the shaft; such that the shaft is sized to fit within the opening; blowing heated air through the plurality of apertures such that the liner is warmed; removing the air infuser from the artificial vagina; adding a second volume of air from the pressurized air tank to the first volume of air thereby decreasing the size of the opening; placing the artificial vagina over a penis of a stallion such that the penis is located in the opening; collecting semen from the stallion. In a related example, the artificial vagina set may have a pump. In a related example, the elongate housing may be at least 14 inches long. In a related example, the elongate housing may have an internal diameter of at least 3.5 inches. In a related example, the artificial vagina set may have temperature sensor attached to the shaft. In a related example, the artificial vagina set may have a temperature controller configured to operate the heating element. In a related example the second valve may be a variable pressure relief valve.

The above-described embodiments have a number of independently useful individual features that have particular utility when used in combination with one another including combinations of features from embodiments described separately. There are, of course, other alternate embodiments which are obvious from the foregoing descriptions of the invention, which are intended to be included within the scope of the invention, as defined by the following claims.

What is claimed is:

1. An artificial vagina set comprising:

a. an elongate housing having a first opening and a second opening;

b. a liner located within the elongate housing wherein the liner is attached to the elongate housing;

c. a volume of air between the elongate housing and the liner;

d. an opening centrally located within the elongate housing and the liner;

e. wherein the volume of air surrounds the opening;

f. wherein the volume of air is both annular and cylindrical;

g. a first valve in fluid communication with the volume of air;

h. a pressurized air tank in fluid communication with the first valve;

i. a second valve in fluid communication with the volume of air, wherein the second valve is a pressure relief valve;

j. a heating element;

k. a blower;

l. a shaft having a plurality of apertures arranged along a length of the shaft;

m. wherein the plurality of apertures is in fluid communication with the heating element;

n. wherein the plurality of apertures is in fluid communication with the blower and o. wherein the shaft is sized to fit within the opening.

2. The artificial vagina set of claim 1 further comprising a pump.

3. The artificial vagina set of claim 1 wherein the elongate housing is at least 14 inches long.

4. The artificial vagina set of claim 1 wherein the elongate housing has an internal diameter of at least 3.5 inches.

5. The artificial vagina set of claim 1 further comprising a temperature sensor attached to the shaft.

6. The artificial vagina set of claim 1 further comprising a temperature controller configured to operate the heating element.

7. The artificial vagina set of claim 1 wherein the wherein the second valve is a variable pressure relief valve.

8. The artificial vagina set of claim 1 further comprising:

a. a pump;

b. a temperature sensor attached to the shaft and c. a temperature controller configured to operate the heating element;

d. wherein the elongate housing is at least 14 inches long;

e. wherein the elongate housing has an internal diameter of at least 3.5 inches and f. wherein the wherein the second valve is a variable pressure relief valve.

9. A collection method comprising:

a. placing a shaft of an air infuser inside of an artificial vagina;

b. wherein the artificial vagina comprises:

i. an elongate housing, ii. a liner located within the elongate housing wherein the liner is attached to the elongate housing, iii. a first volume of air between the elongate housing and the liner, iv. an opening centrally located within the elongate housing and the liner, v. a first valve in fluid communication with the first volume of air, vi. a pressurized air tank in fluid communication with the first valve and vii. a second valve in fluid communication with the first volume of air wherein the second valve is a pressure relief valve;

c. wherein the air infuser comprises i. a heating element and ii. a blower;

d. wherein the shaft has a plurality of apertures arranged along a length of the shaft;

e. wherein the shaft is sized to fit within the opening;

f. blowing heated air through the plurality of apertures such that the liner is warmed;

g. removing the air infuser from the artificial vagina;

h. adding a second volume of air from the pressurized air tank to the first volume of air thereby decreasing the size of the opening;

i. placing the artificial vagina over a penis of a stallion such that the penis is located in the opening;

j. collecting semen from the stallion.

10. The artificial vagina set of claim 9 further comprising a pump.

11. The artificial vagina set of claim 9 wherein the elongate housing is at least 14 inches long.

12. The artificial vagina set of claim 9 wherein the elongate housing has an internal diameter of at least 3.5 inches.

13. The artificial vagina set of claim 9 further comprising a temperature sensor attached to the shaft.

14. The artificial vagina set of claim 9 further comprising a temperature controller configured to operate the heating element.

15. The artificial vagina set of claim 9 wherein the wherein the second valve is a variable pressure relief valve.

16. The artificial vagina set of claim 9 further comprising:

a. a pump;

b. a temperature sensor attached to the shaft and c. a temperature controller configured to operate the heating element;

d. wherein the elongate housing is at least 14 inches long;

e. wherein the elongate housing has an internal diameter of at least 3.5 inches and f. wherein the wherein the second valve is a variable pressure relief valve.

* * * * *